US006469606B1

(12) United States Patent
Tada et al.

(10) Patent No.: US 6,469,606 B1
(45) Date of Patent: Oct. 22, 2002

(54) COIL COMPONENT

(75) Inventors: Masahito Tada; Keiichiro Suzuki; Sadao Nakanishi, all of Fukushima (JP)

(73) Assignee: Kureha Kagaku Kogyo, K.K., Tokyo (JP)

( * ) Notice: Subject to any disclaimer, the term of this patent is extended or adjusted under 35 U.S.C. 154(b) by 0 days.

(21) Appl. No.: 09/582,886

(22) PCT Filed: Dec. 25, 1998

(86) PCT No.: PCT/JP98/05920

§ 371 (c)(1),
(2), (4) Date: Jul. 6, 2000

(87) PCT Pub. No.: WO99/35655

PCT Pub. Date: Jul. 15, 1999

(30) Foreign Application Priority Data

Jan. 6, 1998 (JP) ..... 10-013379

(51) Int. Cl.[7] ..... H01F 27/02
(52) U.S. Cl. ..... 336/83; 336/90; 336/92
(58) Field of Search ..... 336/90, 92, 96, 336/83

(56) References Cited

U.S. PATENT DOCUMENTS

| | | | | | |
|---|---|---|---|---|---|
| 5,138,292 | A | * | 8/1992 | Forster | 335/278 |
| 5,324,767 | A | | 6/1994 | Koyama et al. | |
| 6,137,390 | A | * | 10/2000 | Tung et al. | 336/83 |
| 6,191,675 | B1 | * | 2/2001 | Sudo et al. | 336/96 |

FOREIGN PATENT DOCUMENTS

| | | |
|---|---|---|
| EP | 0637039 | 2/1995 |
| EP | 0771001 | 5/1997 |
| GB | 2220945 | 1/1990 |
| JP | 4-257206 | 9/1992 |
| WO | WO 9109441 | 6/1991 |

* cited by examiner

*Primary Examiner*—Anh Mai
(74) *Attorney, Agent, or Firm*—Dinsmore & Shohl LLP

(57) ABSTRACT

A coil part which is obtained by sealing at least part of the periphery of a coil with a conductor wound on a bobbin with a high heat-conductive and magnetism-impermeable resin composition, and can efficiently guide out a magnetic flux generated to the outside and efficiently radiate heat generated to the outside.

40 Claims, 2 Drawing Sheets

COIL COMPONENT

TECHNICAL FIELD

The present invention relates to a coil part obtained by sealing a coil with a conductor wound on a bobbin with a resin, and more particularly to a coil part capable of efficiently guiding out a magnetic flux generated to the outside and moreover efficiently radiating heat generated to the outside. The present invention also relates to a coil part capable of generating a high magnetic flux density even when a low electric current is used. The coil parts according to the present invention can be applied to various kinds of relays, actuators, switches and the like.

BACKGROUND ART

A coil is an electric circuit device constructed by winding a conductor on the surface of an insulator and having a self-inductance. When an electric current is passed through the coil, a magnetic flux is generated to accelerate electromagnetic induction and the action of electromagnetic force. There have heretofore been known coil parts sealed with a resin for the purpose of protecting a coil from external environments such as temperature, humidity and shock and conducting electrical insulation. More specifically, there are coil parts obtained by winding a conductor around a bobbin (insulating spool for supporting the resulting coil) made of a synthetic resin to form a coil and sealing the periphery thereof with a synthetic resin.

The coil parts of such a structure are widely used in fields of relays, actuators, switches and the like. A high electric current has had to be passed through the coil for smoothly conducting the operation of such a coil part. However, when a high electric current is passed through the coil, heat may be generated to heat-deform the synthetic resin-made bobbin and the portion sealed with the resin by heat accumulation in some cases.

It has heretofore been attempted to seal the whole coil with a magnetism-permeable resin composition comprising a synthetic resin and powdered magnetic material. However, such a resin composition has involved a problem that it is difficult to efficiently guide out a magnetic flux generated to the outside.

DISCLOSURE OF THE INVENTION

It is an object of the present invention to provide a coil part capable of efficiently guiding out a magnetic flux generated to the outside and moreover efficiently radiating heat generated to the outside.

Another object of the present invention is to provide a coil part capable of smoothly conducting operation even when a low electric current is used.

More specifically, it is an object of the present invention to provide a coil part which is an electronic part obtained by sealing a coil with a conductor wound on a synthetic resin-made bobbin with a synthetic resin, may be operated with a low electric current, scarcely undergoes temperature rise and efficiently guides out a magnetic flux to the outside.

The present inventors have carried out an extensive investigation with a view toward overcoming the above-described problems involved in the prior art. As a result, it has been found that when a coil with a conductor wound on a bobbin is sealed with a high heat-conductive and magnetism-impermeable resin composition, heat generated can be efficiently radiated to the outside, and a magnetic flux generated can be efficiently guided out to the outside. Further, when a bobbin formed by a magnetism-permeable resin composition is used, a high magnetic flux density can be generated even when a low electric current is used. The present invention has been led to completion on the basis of these findings.

According to the present invention, there is thus provided a coil part obtained by sealing at least part of the periphery of a coil with a conductor wound on a bobbin with a high heat-conductive and magnetism-impermeable resin composition (A).

The bobbin may be formed from a synthetic resin composition such as a magnetism-permeable resin composition or magnetism-impermeable resin composition. It is preferred to use a bobbin formed from the magnetism-permeable resin composition in that a high magnetic flux density is generated with a low electric current.

The resin seal means that the whole or a part of the periphery of the coil is wrapped and embedded in the high heat-conductive and magnetism-impermeable resin composition (A). When the coil with the conductor wound on the bobbin is sealed with the resin, there can be provided a coil part which is protected from environments such as humidity, active gasses, vibration and shock and improved in heat-radiating ability.

BEST MODE FOR CARRYING OUT THE INVENTION (Construction of Coil Part)

The coil part according to the present invention has a structure that at least part of the periphery of a coil with a conductor wound on a bobbin is sealed with a high heat-conductive and magnetism-impermeable resin composition (A). The bobbin as used herein means an insulating spool for supporting the resulting coil. No particular limitation is imposed on the form of the bobbin, and bobbins in any forms may be used, including publicly known bobbins.

Figure 1:
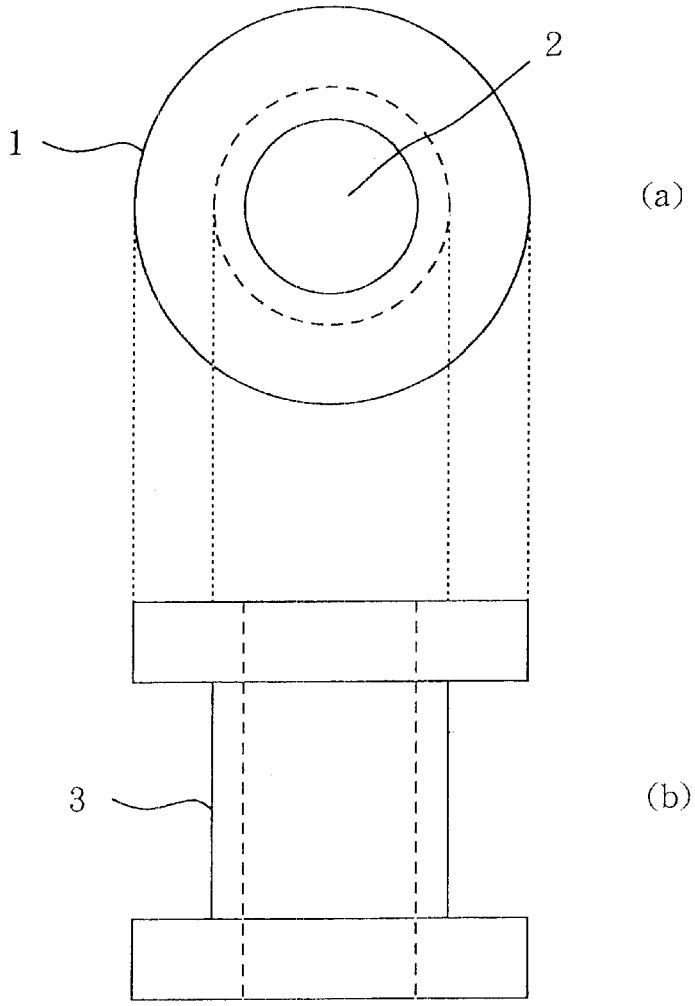
FIGS. 1(*a*) and 1(*b*) are a front elevation and a side elevation illustrating an exemplary bobbin, respectively.

As a specific example of the bobbin, may be mentioned a bobbin having a form illustrated in FIG. 1. FIG. 1(*a*) is a front elevation, and FIG. 1(*b*) is a side elevation. This bobbin has flanges (1) at both ends thereof, and a recess (3) for winding a conductor thereon is formed between both flanges. The bobbin is hollow and has an inner hole (2). The form of the flange is not limited to that illustrated in FIG. 1, and those having no flange may be used. The inner hole (2) is not necessary to the bobbin. Preferred materials for the bobbin will be described subsequently. However, the use of a bobbin formed by a magnetism-permeable resin composition in particular permits the generation of a high magnetic flux density with a low electric current.

Figure 2:
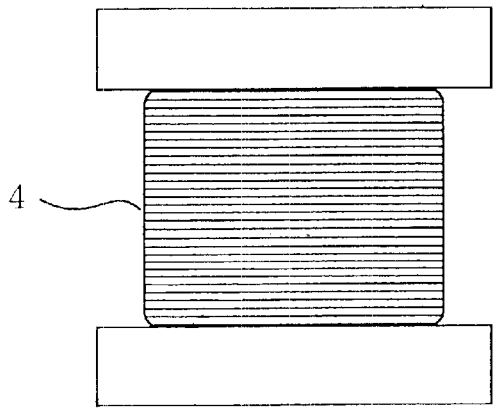
FIG. 2 is a side elevation illustrating a coil with a conductor wound on the bobbin.

No particular limitation is imposed on the conductor. However, a baked wire obtained by applying any of various kinds of synthetic enamels on to an electric conductor and baking the enamel is preferred. Examples of the baked wire include oil-enameled wire, formal wire, polyurethane wire, polyester wire, ester-imide wire, amide-imide wire, polyimide wire and self-fusion-bonded wire. Illustrated in FIG. 2 is an example where a conductor is wound on the recess (3) in the bobbin illustrated in FIG. 1 to form a coil (4) for magnetic-field generation.

Figure 3:
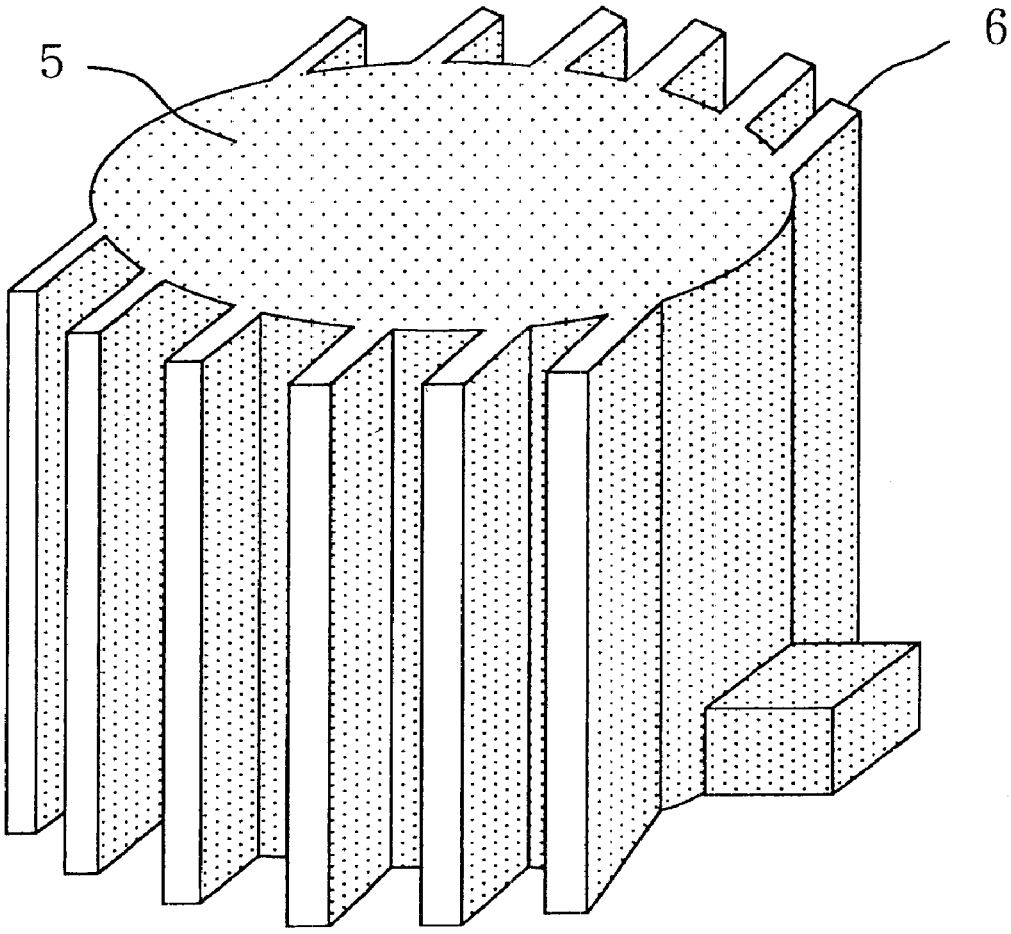
FIG. 3 is a bird's-eye view illustrating an exemplary coil part obtained by sealing the coil with a conductor wound on the bobbin with a resin composition.

The coil part according to the present invention is obtained by sealing a part, or the whole, as needed, of the periphery (including a coil-forming portion and a bobbin) of a coil with a high heat-conductive and magnetism-impermeable resin composition. Illustrated in FIG. 3 is an example of a coil part having a structure that the whole of the periphery of the coil illustrated in FIG. 2 is sealed with the magnetism-impermeable resin composition. On the surface of a sealed portion (5) illustrated in FIG. 3, is formed a radiating structure composed of fins (6) formed by the same magnetism-impermeable resin composition as that used in the sealing. The radiating structure portion composed of the fins or the like may be formed by a metal. The formation of the radiating structure portion by the high heat-conductive and magnetism-impermeable resin composition is preferred from the viewpoint of productivity because the structure can be formed integrally with the sealed portion. When the radiating structure is provided on the surface of the sealed portion, the heat radiated to the outside through the high heat-conductive and magnetism-impermeable resin composition can be more efficiently dissipated.

[High Heat-conductive and Magnetism-impermeable Resin Composition (A)]

The high heat-conductive and magnetism-impermeable resin composition useful in the practice of the present invention is generally a resin composition comprising a synthetic resin (a) and a high heat-conductive and magnetism-impermeable inorganic filler (b), and may contain another magnetism-impermeable inorganic filler (c) than the filler (b) as needed.

As examples of the synthetic resin (a), may be mentioned polyolefins such as polyethylene, polypropylene, ethylene-vinyl acetate copolymers and ionomers; polyamides such as nylon 6, nylon 66, nylon 6/66, nylon 46 and nylon 12; poly(arylene sulfides) such as poly(phenylene sulfide) (PPS), poly(phenylene sulfide ketone) and poly(phenylene sulfide sulfone); polyesters such as polyethylene terephthalate, polybutylene terephthalate and overall aromatic polyesters; polyimide resins such as polyimide, polyether imide and polyamide-imide; styrene resins such as polystyrene and acrylonitrile-styrene copolymers; chlorine-containing vinyl resins such as polyvinyl chloride, polyvinylidene chloride, vinyl chloride-vinylidene chloride copolymers and chlorinated polyethylene; poly(meth) acrylates such as polymethyl acrylate and polymethyl methacrylate; acrylonitrile resins such as polyacrylonitrile and polymethacrylonitrile; fluorocarbon resins such as tetrafluoroethylene/perfluoroalkyl vinyl ether copolymers, polytetrafluoroethylene, tetrafluoroethylene/hexafluoropropylene copolymers and polyvinylidene fluoride; silicone resins such as dimethyl polysiloxane; various kinds of engineering plastics such as polyphenylene oxide, poly(ether ether ketone), poly(ether ketone), polyarylate, polysulfone and poly(ether sulfone); various kinds of thermoplastic resins such as polyacetal, polycarbonate, polyvinyl acetate, polyvinyl formal, polyvinyl butyral, polybutylene, polyisobutylene, polymethylpentene, butadiene resins, polyethylene oxide, oxybenzoyl polyester and poly-p-xylene resins; thermosetting resins such as epoxy resins, phenol resins and unsaturated polyester resins; elastomers such as ethylene-propylene rubber, polybutadiene rubber, styrene-butadiene rubber and chloroprene rubber; thermoplastic elastomers such as styrene-butadiene-styrene block copolymers; etc.

These synthetic resins may be used either singly or in any combination thereof. Among these polymers, polyolefins such as polyethylene and polypropylene, polyamides, and poly(arylene sulfides) such as poly(phenylene sulfide) are preferred from the viewpoint of moldability. From the viewpoints of heat resistance and sealing and molding ability, poly(arylene sulfides) such as poly(phenylene sulfide) are particularly preferred. The poly(arylene sulfides) have a melt viscosity of generally 5 to 1,000 Pa·s, preferably 10 to 500 Pa·S as measured at 310° C. and a shear rate of 1,000/sec.

As examples of the high heat-conductive and magnetism-impermeable inorganic filler (b) useful in the practice of the present invention, may be mentioned metal oxides such as alumina, silicon oxide, iron oxide, calcium oxide and magnesium oxide; metals such as zinc, tin, aluminum, brass, gold, silver, copper, platinum, beryllium, bronze, beryllium copper, stainless steel and nickel; and besides graphite, calcite, fluorite and boron nitride. These high heat-conductive and magnetism-impermeable inorganic fillers are generally used in the form of powder or fiber. Among these fillers, metal oxides are preferred from the viewpoints of stability in the air and electric resistance, with alumina powder or alumina fiber being particularly preferred. As the alumina, is preferred $\alpha$-alumina, with spherical $\alpha$-alumina particles having an average particle diameter of about 5 to 80 $\mu$m being particularly preferred.

In the present invention, another magnetism-impermeable inorganic filler (c) than the high heat-conductive and magnetism-impermeable inorganic filler (b) may be used in combination though it is not high in heat conductivity. As examples of such a magnetism-impermeable inorganic filler (c), may be mentioned silica, diatomaceous earth, titanium oxide, zinc oxide, antimony oxide, beryllium oxide, pumice, aluminum hydroxide, magnesium hydroxide, basic magnesium carbonate, calcium carbonate, magnesium carbonate, dolomite, dawsonite, calcium sulfate, barium sulfate, ammonium sulfate, calcium sulfite, talc, clay, mica, asbestos, glass, calcium silicate, montmorillonite, bentonite, carbon black, molybdenum sulfide, silicon carbide, potassium titanate, zinc titanate zirconate, zinc borate, barium metaborate, calcium borate and sodium borate. These other magnetism-impermeable inorganic fillers (c) are generally used in the form of powder or fiber. Among these fillers, fibrous fillers such as glass fiber are particularly preferred from the viewpoints of strength, dimensional stability and the like.

The thermal conductivity of the high heat-conductive and magnetism-impermeable resin composition (A) is preferably 0.7 W/mK or higher. If the thermal conductivity of the magnetism-impermeable resin composition (A) is too low, it is difficult to efficiently radiate heat generated from the coil for magnetic-field generation to the outside, so that temperature rise occurs due to heat accumulation to become liable to fuse or deform the synthetic resin-made bobbin and the sealed portion. The thermal conductivity of the magnetism-impermeable resin composition (A) is more preferably 1.0 W/mK or higher, particularly preferably 1.5 W/mK or higher. The upper limit of the thermal conductivity of the magnetism-impermeable resin composition (A) is about 5.0 W/mK.

The volume resistivity of the high heat-conductive and magnetism-impermeable resin composition (A) is preferably $1.0\times10^9$ Ωcm [[1.0E+9] Ωcm] or higher. If the volume resistivity of the magnetism-impermeable resin composition (A) is too low, there is a possibility that when breaking of wire occurs in the coil, problems such as abnormal heat generation may arise due to short-circuit between terminals.

The volume resistivity of the magnetism-impermeable resin composition (A) is more preferably $1.0\times10^{11}$ Ωcm or higher, particularly preferably $1.0\times10^{13}$ Ωcm or higher. The upper limit of the volume resistivity of the magnetism-impermeable resin composition (A) is about $1.0\times10^{16}$ Ωcm.

The blending proportions of the individual components are determined taking respective preferable ranges of thermal conductivity and volume resistivity, and sealing and molding ability of the resulting resin composition, mechanical properties of a portion to be sealed with the resin composition, etc. into consideration. More specifically, the synthetic resin (a) is blended in a proportion of generally 10 to 80 wt. %, preferably 15 to 60 wt. %, the high heat-conductive and magnetism-impermeable inorganic filler (b) in a proportion of generally 90 to 20 wt. %, preferably 85 to 40 wt. % and another magnetism-impermeable inorganic filler (c) in a proportion of generally 0 to 30 wt. %, preferably 0 to 25 wt. %.

If the blending proportion of the synthetic resin (a) is too high, and the blending proportion of the high heat-conductive and magnetism-impermeable inorganic filler (b) is too low, the heat conductivity of a portion sealed with the resulting resin composition is lowered, resulting in difficulty in efficiently radiating heat generated to the outside. If the blending proportion of the synthetic resin (a) is too low, and the blending proportion of the high heat-conductive and magnetism-impermeable inorganic filler (b) is too high, the sealing and molding ability of the resulting resin composition and the strength of a portion sealed with the resin composition are lowered. If the blending proportion of said another magnetism-impermeable inorganic filler (c) is too high, the heat conductivity of a portion sealed with the resulting resin composition is lowered.

The magnetism-impermeable resin composition (A) is preferably a resin composition containing/poly(phenylene sulfide) as the synthetic resin (a) α-alumina as the high heat-conductive and magnetism-impermeable inorganic filler (b) and glass fiber as said another magnetism-impermeable inorganic filler (c). This resin composition more preferably has a thermal conductivity of 0.7 W/mK or higher and a volume resistivity of $1.0\times10^{9}$ Ωcm or higher.

[Synthetic Resin Composition (B)]

In the present invention, a bobbin formed from a synthetic resin composition (B) is preferably used. The synthetic resin composition (B) is roughly divided into a magnetism-permeable resin composition ($B_1$) and a magnetism-impermeable resin composition ($B_2$).

When a bobbin formed from the magnetism-permeable resin composition ($B_1$) is used, it is possible to generate a high magnetic flux density with a low electric current. The magnetism-permeable resin composition ($B_1$) is generally a resin composition comprising a synthetic resin (d) and a powdered magnetic material (e) and may contain a magnetism-impermeable inorganic filler (f) as needed.

As examples of the synthetic resin (d), may be mentioned polyolefins such as polyethylene, polypropylene, ethylene-vinyl acetate copolymers and ionomers; polyamides such as nylon 6, nylon 66, nylon 6/66, nylon 46 and nylon 12; poly(arylene sulfides) such as poly(phenylene sulfide) (PPS), poly(phenylene sulfide ketone) and poly(phenylene sulfide sulfone); polyesters such as polyethylene terephthalate, polybutylene terephthalate and overall aromatic polyesters; polyimide resins such as polyimide, polyether imide and polyamide-imide; styrene resins such as polystyrene and acrylonitrile-styrene copolymers; chlorine-containing vinyl resins such as polyvinyl chloride, polyvinylidene chloride, vinyl chloride-vinylidene chloride copolymers and chlorinated polyethylene; poly(meth) acrylates such as polymethyl acrylate and polymethyl methacrylate; acrylonitrile resins such as polyacrylonitrile and polymethacrylonitrile; fluorocarbon resins such as tetrafluoroethylene/perfluoroalkyl vinyl ether copolymers, polytetrafluoroethylene, tetrafluoroethylene/hexafluoropropylene copolymers and polyvinylidene fluoride; silicone resins such as dimethyl polysiloxane; various kinds of engineering plastics such as polyphenylene oxide, poly(ether ether ketone), poly(ether ketone), polyarylate, polysulfone and poly(ether sulfone); various kinds of thermoplastic resins such as polyacetal, polycarbonate, polyvinyl acetate, polyvinyl formal, polyvinyl butyral, polybutylene, polyisobutylene, polymethylpentene, butadiene resins, polyethylene oxide, oxybenzoyl polyester and poly-p-xylene resins; thermosetting resins such as epoxy resins, phenol resins and unsaturated polyester resins; elastomers such as ethylene-propylene rubber, polybutadiene rubber, styrene-butadiene rubber and chloroprene rubber; thermoplastic elastomers such as styrene-butadiene-styrene block copolymers; etc.

These synthetic resins may be used either singly or in any combination thereof. Among these polymers, polyolefins such as polyethylene and polypropylene, polyamides, and poly(arylene sulfides) such as poly(phenylene sulfide) are particularly preferred from the viewpoint of moldability. From the viewpoints of moldability and heat resistance, poly(arylene sulfides) such as poly(phenylene sulfide) are particularly preferred. The poly(arylene sulfides) have a melt viscosity of generally 5 to 1,000 Pa·s, preferably 10 to 500 Pa·S as measured at 310° C. and a shear rate of 1,000/sec.

Examples of the powdered magnetic material (e) include metal oxide type powdered magnetic materials such as Mg—Zn ferrite powder, Ni—Zn ferrite powder and Mn—Zn ferrite powder; metal alloy type powdered magnetic materials such as carbonyl iron powder, alperm powder, sendust powder, super sendust powder, permalloy powder and Fe—Si—B type alloy powder; etc. Among these, metal oxide type powdered magnetic materials such as Mg—Zn ferrite powder, Ni—Zn ferrite powder and Mn—Zn ferrite powder are preferred as the powdered magnetic powder (e) from the viewpoint of stability in the air. Of these metal oxide type powdered magnetic materials, Mg—Zn ferrite powder and Ni—Zn ferrite powder are particularly preferred in that they have a high electric resistance. These powdered magnetic materials may be used either singly or in any combination thereof.

The A.C. initial permeability of the magnetism-permeable resin composition ($B_1$) is preferably 2 or higher. When a bobbin formed from a the magnetism-permeable resin composition ($B_1$) having a high A.C. initial permeability is used in the coil part according to the present invention, a magnetic flux density generated becomes markedly high compared with a bobbin formed from a magnetism-impermeable resin composition. Therefore, a desired magnetic flux density can be generated with a lower electric current applied to effectively prevent the generation of heat from the coil for magnetic-field generation. Such a bobbin has a merit of easily miniaturizing the coil part. The A.C. initial permeability of the magnetism-permeable resin composition ($B_1$) is more preferably 5 or higher, particularly preferably 10 or higher. The upper limit of the A.C. initial permeability of the magnetism-permeable resin composition ($B_1$) is about 20.

The volume resistivity of the magnetism-permeable resin composition ($B_1$) is preferably $1.0\times10^{9}$ Ωcm or higher. If the volume resistivity of the magnetism-permeable resin composition ($B_1$) is too low, the bobbin formed therefrom may be fused in some cases when defects such as pinholes arise in the wire upon passing an electric current through the coil.

The blending proportions of the individual components are determined taking respective preferable ranges of A.C. initial permeability and volume resistivity, mechanical strength, moldability, etc. of the resulting resin composition into consideration. More specifically, the synthetic resin (d) is blended in a proportion of generally 10 to 80 wt. %, preferably 10 to 50 wt. %, particularly preferably 10 to 30 wt. %, and the powdered magnetic material (e) in a proportion of generally 90 to 20 wt. %, preferably 90 to 50 wt. %, particularly preferably 90 to 70 wt. %. If the blending proportion of the synthetic resin (d) is too high, and the blending proportion of the powdered magnetic material (e) is too low, it is difficult to achieve A.C. initial permeability and volume resistivity within the respective desired ranges. If the blending proportion of the powdered magnetic material (e) is too high, the moldability and strength of the resulting resin composition are lowered.

In the magnetism-permeable resin composition ($B_1$), as needed, may be contained a powdered or fibrous non-magnetic filler such as silica, diatomaceous earth, almina, titanium oxide, zinc oxide, magnesium oxide, antimony oxide, beryllium oxide, pumice, aluminum hydroxide, magnesium hydroxide, basic magnesium carbonate, calcium carbonate, magnesium carbonate, dolomite, dawsonite, calcium sulfate, barium sulfate, ammonium sulfate, calcium sulfite, talc, clay, mica, asbestos, glass, calcium silicate, montmorillonite, bentonite, carbon black, graphite, aluminum, molybdenum sulfide, silicon carbide, potassium titanate, zinc titanate zirconate, zinc borate, barium metaborate, calcium borate or sodium borate. These non-magnetic fillers are used within a range of generally 30 wt. % or lower, preferably 20 wt. % or lower based on the total weight of the composition.

In the present invention, a bobbin formed from a magnetism-impermeable resin composition ($B_2$) may be used. The A.C. initial permeability of the magnetism-impermeable resin composition ($B_2$) is lower than 2. The volume resistivity of the magnetism-impermeable resin composition ($B_2$) is preferably $1.0\times10^9$ Ωcm or higher by the reason described above.

The magnetism-impermeable resin composition ($B_2$) is generally a resin composition comprising 10 to 80 wt. % of a synthetic resin (d) and 20 to 90 wt. % of a magnetism-impermeable inorganic filler (f). The synthetic resin (d) is at least one selected from the group consisting of the above-mentioned thermoplastic resins, thermosetting resins and thermoplastic elastomers. As the thermoplastic resins, are preferred polyolefins, polyamide and poly(arylene sulfides). Among these, poly(arylene sulfides) such as poly(phenylene sulfide) are particularly preferred.

The magnetism-impermeable inorganic filler (f) is at least one selected from the group consisting of powdered metal oxides and fibrous fillers. Examples of the magnetism-impermeable inorganic filler (f) include the same kind of high heat-conductive and magnetism-impermeable inorganic fillers ($f_1$) as the above-mentioned magnetism-impermeable inorganic fillers (b) and the same kind of other magnetism-impermeable inorganic fillers ($f_2$) as the above-mentioned magnetism-impermeable inorganic fillers (c). The magnetism-impermeable resin composition ($B_2$) is preferably a resin composition containing 10 to 80 wt. % of the synthetic resin (d), 20 to 90 wt. % of the high heat-conductive and magnetism-impermeable inorganic fillers ($f_1$) and 0 to 30 wt. % of said another magnetism-impermeable inorganic filler ($f_2$) from the viewpoint of heat-radiating ability.

The magnetism-impermeable resin composition ($B_2$) is particularly preferably a resin composition containing poly (phenylene sulfide) as the synthetic resin (d), α-alumina as the high heat-conductive and magnetism-impermeable inorganic filler ($f_1$) and glass fiber as said another magnetism-impermeable inorganic filler ($f_2$).

(Production of Coil Part)

As a process for producing the coil part according to the present invention, may be adopted a process in which a coil with a conductor wound on a bobbin is placed in a mold, and a high heat-conductive and magnetism-impermeable resin composition (A) is injection-molded to form a sealed portion on the periphery of the coil. It is generally preferred that the whole bobbin including the coiled portion be sealed with the resin composition. An injection molding process is generally used for forming a bobbin from the magnetism-permeable resin composition ($B_1$) or the magnetism-impermeable resin composition ($B_2$).

EXAMPLES

The present invention will hereinafter be described more specifically by the following Examples and Comparative Examples.

Physical properties in the examples were measured in accordance with the following respective methods:

(1) External magnetic flux density:

The external magnetic flux density was measured by means of a Gauss meter 3251 model manufactured by Yokogawa Denki Corp.

(2) A.C. initial permeability:

The A.C. initial permeability was measured in accordance with JIS C 2561.

(3) Volume resistivity:

The volume resistivity was measured in accordance with ASTM D 257.

(4) Characteristic (surface temperature) of coil part:

A direct current was passed through each coil part in an atmosphere of 23° C. to adjust the coil part in such a manner that the external magnetic reflux density thereof is 1,000 Gauss. After 10 minutes elapsed, the surface temperature of the coil part was measured.

Example 1

<Preparation of Mg—Zn Ferrite>

A mixture composed of MgO (10.9 wt. %), ZnO (14.8 wt. %), CuO (1.2 wt. %), MnO (3.2 wt. %), CaO (0.16 wt. %), $SiO_2$ (0.07 wt. %), NiO (0.06 wt. %), $Bi_2O_3$ (0.3 wt. %), PbO (0.01 wt. %) and $Fe_2O_3$ (69.3 wt. %) was temporarily calcined at about 1,000° C., ground and then granulated by means of a spray dryer in accordance with a method known per se in the art. The resultant granules were calcined at 1,350° C. for about 3 hours to obtain a sintered material of Mg—Zn ferrite. This sintered material was ground by a hammer mill to obtain powder having an average particle diameter of 47 μm. The specific gravity of the powder thus obtained was 4.6.

<Preparation of Magnetism-permeable Resin Composition>

In a 20-liter Henschel mixer were mixed 17 kg of the Mg—Zn ferrite powder obtained above and 3 kg of poly (phenylene sulfide) (product of Kureha Kagaku Kogyo K.K.; melt viscosity at 310° C. and a shear rate of 1,000/sec: about 20 Pa·s). The resultant mixture was fed to a twin-screw extruder preset at 280 to 330° C. and melted and kneaded, thereby obtaining a magnetism-permeable resin composition. The magnetism-permeable resin composition had an A.C. initial permeability of 15 and a volume resistivity of $1.5\times10^{9}$ Ωcm.

<Production of Bobbin>

The magnetism-permeable resin composition obtained above was fed to an injection molding machine (J-75ED manufactured by The Japan Steel Works, Ltd.) and injection-molded at a cylinder temperature of 280 to 310° C., an injection pressure of about 1,000 kgf/cm$^2$ and a mold temperature of about 160° C., thereby producing a bobbin having a structure illustrated in FIG. 1.

<Production of Coil>

An enameled wire was wound around a recess in the bobbin obtained above to form a coil illustrated in FIG. 2. Terminals for external connection were respectively formed at both ends of the enameled wire to produce a coil for magnetic-field generation.

<Preparation of Magnetism-impermeable Resin Composition>

In a 20-liter Henschel mixer were mixed 16 kg of α-alumina (AS-50, product of Showa Denko K.K.) and 4 kg of poly(phenylene sulfide) (product of Kureha Kagaku Kogyo K.K.; melt viscosity at 310° C. and a shear rate of 1,000/sec: about 20 Pa·s). The resultant mixture was fed to a twin-screw extruder preset at 280 to 330° C. and melted and kneaded, thereby obtaining a magnetism-impermeable resin composition. The magnetism-impermeable resin composition had a thermal conductivity of 3 W/mK and a volume resistivity of $1.0\times10^{15}$ Ωcm.

<Production of Coil Part>

The coil for magnetic-field generation obtained above was placed in a mold, while the magnetism-impermeable resin composition was fed to an injection molding machine (J-75ED manufactured by The Japan Steel Works, Ltd.) and injection-molded in the mold at a cylinder temperature of 280 to 310° C., an injection pressure of about 1,000 kgf/cm$^2$ and a mold temperature of about 160° C., thereby sealing the whole periphery of the coil for magnetic-field generation to produce a coil part. A direct current was passed through the coil part thus obtained in an atmosphere of 23° C. to adjust the coil part in such a manner that the external magnetic reflux density thereof is 1,000 Gauss. After 10 minutes elapsed, the surface temperature of the coil part was measured and found to be 28° C. The result is shown in Table 1.

Example 2

<Preparation of Magnetism-impermeable Resin Composition>

In a 20-liter Henschel mixer, were mixed 8 kg of α-alumina (AS-50, product of Showa Denko K.K.), 4 kg of glass fiber (product of Asahi Fiber Glass Co., Ltd.; diameter: 13 μm) and 8 kg of poly(phenylene sulfide) (product of Kureha Kagaku Kogyo K.K.; melt viscosity at 310° C. and a shear rate of 1,000/sec: about 20 Pa·s). The resultant mixture was fed to a twin-screw extruder preset at 280 to 330° C. and melted and kneaded, thereby obtaining a magnetism-impermeable resin composition. The magnetism-impermeable resin composition had a thermal conductivity of 1.2 W/mK and a volume resistivity of $1.0\times10^{15}$ Ωcm.

<Production of Coil Part>

A coil part was produced in the same manner as in Example 1 except that the above-described magnetism-impermeable resin composition was used to conduct sealing. A direct current was passed through the coil part thus obtained in an atmosphere of 23° C. to adjust the coil part in such a manner that the external magnetic reflux density thereof is 1,000 Gauss. After 10 minutes elapsed, the surface temperature of the coil part was measured and found to be 31° C. The result is shown in Table 1.

Example 3

<Preparation of Magnetism-impermeable Resin Composition>

In a 20-liter Henschel mixer, were mixed 6 kg of α-alumina (AS-50, product of Showa Denko K.K.), 4 kg of glass fiber (product of Asahi Fiber Glass Co., Ltd.; diameter: 13 μm) and 10 kg of poly(phenylene sulfide) (product of Kureha Kagaku Kogyo K.K.; melt viscosity at 310° C. and a shear rate of 1,000/sec: about 20 Pa·s). The resultant mixture was fed to a twin-screw extruder preset at 280 to 330° C. and melted and kneaded, thereby obtaining a magnetism-impermeable resin composition. The magnetism-impermeable resin composition had a thermal conductivity of 0.8 W/mK and a volume resistivity of $1.0\times10^{15}$ Ωcm.

<Production of Coil Part>

A coil part was produced in the same manner as in Example 1 except that the above-described magnetism-impermeable resin composition was used to conduct sealing. A direct current was passed through the coil part thus obtained in an atmosphere of 23° C. to adjust the coil part in such a manner that the external magnetic reflux density thereof is 1,000 Gauss. After 10 minutes elapsed, the surface temperature of the coil part was measured and found to be 42° C. The result is shown in Table 1.

Example 4

<Production of Bobbin>

A magnetism-permeable resin composition was prepared in the same manner as in Example 2. The magnetism-permeable resin composition thus obtained was fed to an injection molding machine (J-75ED manufactured by The Japan Steel Works, Ltd.) and injection-molded at a cylinder temperature of 280 to 310° C., an injection pressure of about 1,000 kgf/cm$^2$ and a mold temperature of about 160° C., thereby producing a bobbin having a structure illustrated in FIG. 1.

<Production of Coil>

The bobbin obtained above was used to produce a coil for magnetic-field generation by a process similar to Example 1.

<Production of Coil Part>

A magnetism-impermeable resin composition was prepared in the same manner as in Example 3. A coil part was produced in the same manner as in Example 1 except that the magnetism-impermeable resin composition thus obtained was used to seal the coil for magnetic-field generation. A direct current was passed through the coil part thus obtained in an atmosphere of 23° C. to adjust the coil part in such a manner that the external magnetic reflux density thereof is 1,000 Gauss. After 10 minutes elapsed, the surface temperature of the coil part was measured and found to be 44° C. The result is shown in Table 1.

Comparative Example 1

<Preparation of Magnetism-impermeable Resin Composition>

In a 20-liter Henschel mixer were mixed 8 kg of glass fiber (product of Asahi Fiber Glass Co., Ltd.; diameter: 13 μm) and 12 kg of poly(phenylene sulfide) (product of Kureha Kagaku Kogyo K.K.; melt viscosity at 310° C. and a shear rate of 1,000/sec: about 20 Pa·s). The resultant mixture was fed to a twin-screw extruder preset at 280 to 330° C. and melted and kneaded, thereby obtaining a magnetism-impermeable resin composition. The magnetism-impermeable resin composition had an A.C. initial permeability of 1, a thermal conductivity of 0.4 W/mK and a volume resistivity of $1.0\times10^{15}$ Ωcm.

<Production of Coil Part>

A coil part was produced in the same manner as in Example 1 except that the magnetism-impermeable resin composition was used to produce a bobbin, and the same magnetism-impermeable resin composition was used to conduct sealing. A direct current was passed through the coil part thus obtained in an atmosphere of 23° C. to adjust the coil part in such a manner that the external magnetic reflux density thereof is 1,000 Gauss. After 10 minutes elapsed, the surface temperature of the coil part was measured and found to be 160° C. The result is shown in Table 1.

Comparative Example 2

A coil part was produced in the same manner as in Example 1 except that the magnetism-impermeable resin composition obtained in Comparative Example 1 was used to conduct sealing. A direct current was passed through the coil part thus obtained in an atmosphere of 23° C. to adjust the coil part in such a manner that the external magnetic reflux density thereof is 1,000 Gauss. After 10 minutes elapsed, the surface temperature of the coil part was measured and found to be 55° C. The result is shown in Table 1.

Comparative Example 3

A coil part was produced in the same manner as in Example 1 except that the magnetism-permeable resin composition (thermal conductivity: 2.1 W/mK, volume resistivity: $1.5\times10^{9}$ Ωcm.) obtained in Example 1 was used to conduct sealing. A direct current was passed through the coil part thus obtained in an atmosphere of 23° C. to adjust the coil part in such a manner that the external magnetic reflux density thereof is 1,000 Gauss. After 10 minutes elapsed, the surface temperature of the coil part was measured and found to be 200° C. The result is shown in Table 1.

INDUSTRIAL APPLICABILITY

The coil parts according to the present invention can efficiently guide out a magnetic flux generated to the outside and moreover can efficiently radiate heat generated to the outside because a coil with a conductor wound on a bobbin is sealed with a high heat-conductive and magnetism-impermeable resin composition. When a bobbin formed from a magnetism-permeable resin composition is used, a high magnetic flux density can be generated even when a low electric current is used. The coil parts according to the present invention can be applied to various kinds of relays, actuators, switches and the like and particularly to fields in which it has heretofore been difficult to miniaturize them due to heat generation.

What is claimed is:

1. A coil part obtained by sealing at least part of the periphery of a coil with a conductor wound on a bobbin with a high heat-conductive and magnetism-impermeable resin composition (A) comprising 10 to 80 wt. % of a synthetic resin (a), 90 to 20 wt. % of a high heat-conductive and magnetism-impermeable inorganic filler (b), and 0 to 30 wt. % of another magnetism-impermeable inorganic filler (c).

2. The coil part according to claim 1, wherein the thermal conductivity of the magnetism-impermeable resin composition (A) is 0.7 W/mK or higher.

3. The coil part according to claim 1, wherein the volume resistivity of the magnetism-impermeable resin composition (A) is $1.0\times10^{9}$ Ωcm or higher.

4. The coil part according to claim 1, wherein the high heat-conductive and magnetism-impermeable resin composition (A) has a thermal conductivity of 0.7 W/mK or higher and a volume resistivity of $1.0\times10^{9}$ Ωcm or higher.

5. The coil part according to claim 1, wherein the synthetic resin (a) is at least one synthetic resin selected from the group consisting of thermoplastic resins, thermosetting resins and thermoplastic elastomers.

TABLE 1

| | Material for bobbin | | | | | | Material for sealed portion | | | | | | Characteristic |
|---|---|---|---|---|---|---|---|---|---|---|---|---|---|
| | Resin | | Filler | | AC | Volume | Resin | | Filler | | Thermal | Volume | of coil part |
| | Kind | Amount added (wt. %) | Kind | Amount added (wt. %) | initial permeability | resistivity (Ωcm) | Kind | Amount added (wt. %) | Kind | Amount added (wt. %) | conductivity (W/mK) | resistivity (Ωcm) | Surface temperature (° C.) |
| Ex. 1 | PPS | 15 | Mg—Zn ferrite | 85 | 15 | 1.5E + 09 | PPS | 20 | Alumina | 80 | 3 | 1.0E + 15 | 28 |
| Ex. 2 | PPS | 15 | Mg—Zn ferrite | 85 | 15 | 1.5E + 09 | PPS | 40 | Alumina<br>Glass fiber | 40<br>20 | 1.2 | 1.0E + 15 | 31 |
| Ex. 3 | PPS | 15 | Mg—Zn ferrite | 85 | 15 | 1.5E + 09 | PPS | 50 | Alumina<br>Glass fiber | 30<br>20 | 0.8 | 1.0E + 15 | 42 |
| Ex. 4 | PPS | 40 | Alumina<br>Glass fiber | 40<br>20 | 1 | 1.0E + 15 | PPS | 50 | Alumina<br>Glass fiber | 30<br>20 | 0.8 | 1.0E + 15 | 44 |
| Comp. Ex. 1 | PPS | 60 | Glass fiber | 40 | 1 | 1.0E + 15 | PPS | 60 | Glass fiber | 40 | 0.4 | 1.0E + 15 | 160 |
| Comp. Ex. 2 | PPS | 15 | Mg—Zn ferrite | 85 | 15 | 1.5E + 09 | PPS | 60 | Glass fiber | 40 | 0.4 | 1.0E + 15 | 55 |
| Comp. Ex. 3 | PPS | 15 | Mg—Zn ferrite | 85 | 15 | 1.5E + 09 | PPS | 15 | Mg—Zn ferrite | 85 | 2.1 | 1.5E + 09 | 200 |

(Note)

(1) PPS: Poly(phenylene sulfide) (product of Kureha Kagaku Kogyo K.K.; melt viscosity at 310° C. and a shear rate of 1,000/sec: about 20 Pa · s)

(2) Alumina: α-Alumina (AS-50, product of Showa Denko K.K.; average particle diameter: 10 μm)

(3) Glass fiber: Product of Asahi Fiber Glass Co., Ltd.; diameter: 13 μm (4) The measured values of the volume resistivity were expressed in such a manner that, for example, $1.5\times10^{9}$ Ωcm is equal to (1.5E + 09) Ωcm.

6. The coil part according to claim 5, wherein the thermoplastic resin is a polyolefin, polyamide or poly(arylene sulfide).

7. The coil part according to claim 6, wherein the poly (arylene sulfide) is poly(phenylene sulfide).

8. The coil part according to claim 1, wherein the high heat-conductive and magnetism-impermeable inorganic filler (b) is at least one selected from the group consisting of alumina, silicon oxide, iron oxide, calcium oxide, magnesium oxide, zinc, tin, aluminum, brass, gold, silver, copper, platinum, beryllium, bronze, beryllium copper, stainless steel, nickel, graphite, calcite, fluorite and boron nitride.

9. The coil part according to claim 8, wherein the high heat-conductive and magnetism-impermeable inorganic filler (b) is at least one selected from the group consisting of alumina, silicon oxide, iron oxide, calcium oxide and magnesium oxide.

10. The coil part according to claim 9, wherein the metal oxide is alumina.

11. The coil part according to claim 10, wherein the alumina is α-alumina.

12. The coil part according to claim 1, wherein said another magnetism-impermeable inorganic filler (c) is a fibrous filler.

13. The coil part according to claim 12, wherein the fibrous filler is glass fiber.

14. The coil part according to claim 1, wherein the high magnetism-impermeable resin composition (A) is a resin composition containing poly(phenylene sulfide) as the synthetic resin (a), α-alumina as the high heat-conductive and magnetism-impermeable inorganic filler (b) and glass fiber as said another magnetism-impermeable inorganic filler (c).

15. The coil part according to claim 14, wherein the magnetism-impermeable resin composition (A) has a thermal conductivity of 0.7 W/mK or higher and a volume resistivity of $1.0\times10^9$ Ωcm or higher.

16. The coil part according to claim 1, wherein the bobbin is formed from a synthetic resin composition (B).

17. The coil part according to claim 16, wherein the synthetic resin composition (B) is a magnetism-permeable resin composition ($B_1$).

18. The coil part according to claim 17, wherein the magnetism-permeable resin composition ($B_1$) has an A.C. initial permeability of 2 or higher.

19. The coil part according to claim 17, wherein the magnetism-permeable resin composition ($B_1$) has a volume resistivity of $1.0\times10^9$ Ωcm or higher.

20. The coil part according to claim 17, wherein the magnetism-permeable resin composition ($B_1$) is a resin composition containing 10 to 80 wt. % of a synthetic resin (d), 20 to 90 wt. % of a powdered magnetic material (e) and 0 to 30 wt. % of a magnetism-impermeable inorganic filler (f).

21. The coil part according to claim 20, wherein the synthetic resin (d) is at least one synthetic resin selected from the group consisting of thermoplastic resins, thermosetting resins and thermoplastic elastomers.

22. The coil part according to claim 21, wherein the thermoplastic resin is a polyolefin, polyamide or poly (arylene sulfide).

23. The coil part according to claim 22, wherein the poly(arylene sulfide) is poly(phenylene sulfide).

24. The coil part according to claim 20, wherein the powdered magnetic material (e) is at least one selected from the group consisting of metal oxide type powdered magnetic materials and metal alloy type powdered magnetic materials.

25. The coil part according to claim 20, wherein the powdered magnetic material (e) is at least one metal oxide type powdered magnetic material selected from the group consisting of Mg—Zn ferrite and Ni—Zn ferrite.

26. The coil part according to claim 16, wherein the synthetic resin composition (B) is a magnetism-impermeable resin composition ($B_2$).

27. The coil part according to claim 26, wherein the magnetism-impermeable resin composition ($B_2$) has a volume resistivity of $1.0\times10^9$ Ωcm or higher.

28. The coil part according to claim 26, wherein the magnetism-impermeable resin composition ($B_2$) is a resin composition containing 10 to 80 wt. % of a synthetic resin (d) and 20 to 90 wt. % of a magnetism-impermeable inorganic filler (f).

29. The coil part according to claim 28, wherein the synthetic resin (d) is at least one synthetic resin selected from the group consisting of thermoplastic resins, thermosetting resins and thermoplastic elastomers.

30. The coil part according to claim 29, wherein the thermoplastic resin is a polyolefin, polyamide or poly (arylene sulfide).

31. The coil part according to claim 30, wherein the poly(arylene sulfide) is poly(phenylene sulfide).

32. The coil part according to claim 28, wherein the magnetism-impermeable inorganic filler (f) is at least one selected from the group consisting of powdered metal oxides and fibrous fillers.

33. The coil part according to claim 26, wherein the magnetism-impermeable resin composition ($B_2$) is a resin composition containing 10 to 80 wt. % of a synthetic resin (d), 20 to 90 wt. % of a high heat-conductive and magnetism-impermeable inorganic filler (fl) and 0 to 30 wt. % of another magnetism-impermeable inorganic filler ($f_2$).

34. The coil part according to claim 33, wherein the magnetism-impermeable resin composition ($B_2$) is a resin composition containing poly(phenylene sulfide) as the synthetic resin (d), α-alumina as the high heat-conductive and magnetism-impermeable inorganic filler (fl) and glass fiber as said another magnetism-impermeable inorganic filler ($f_2$).

35. The coil part according to claim 1, wherein the coil part obtained by sealing with the magnetism-impermeable resin composition (A) has a radiating structure portion on the surface of the sealed portion.

36. The coil part according to claim 35, wherein the radiating structure portion is composed of fins formed integrally with the sealed portion formed by the magnetism-impermeable resin composition (A).

37. A coil part obtained by sealing at least part of the periphery of a coil with a conductor wound on a bobbin with a high heat-conductive and magnetism-impermeable resin composition (A), wherein the bobbin is formed from a magnetism-permeable synthetic resin composition ($B_1$) having an A.C. initial permeability of 2 or higher.

38. The coil part according to claim 37, wherein the high heat-conductive and magnetism-impermeable resin composition (A) has a thermal conductivity of 0.7 W/mK or higher and a volume resistivity of $1.0\times10^9$ Ωcm or higher.

39. A coil part obtained by sealing at least part of the periphery of a coil with a conductor wound on a bobbin with a high heat-conductive and magnetism-impermeable resin composition (A), wherein the bobbin is formed from a magnetism-permeable synthetic resin composition ($B_1$) which comprises 10 to 80 wt. % of a synthetic resin (d), 20 to 90 wt. % of a powdered magnetic material (e), and 0 to 30 wt. % of a magnetism-impermeable inorganic filler (f).

40. The coil part according to claim 39, wherein the high heat-conductive and magnetism-impermeable resin composition (A) has a thermal conductivity of 0.7 W/mK or higher and a volume resistivity of $1.0\times10^9$ Ωcm or higher.

* * * * *

UNITED STATES PATENT AND TRADEMARK OFFICE

CERTIFICATE OF CORRECTION

PATENT NO. : 6,469,606 B1 
DATED : October 22, 2002
INVENTOR(S) : Masahito Tada et al.

It is certified that error appears in the above-identified patent and that said Letters Patent is hereby corrected as shown below:

Column 14,
Lines 28 and 34, change "(fl)" to -- ($f_1$) --.

Signed and Sealed this

Eighteenth Day of February, 2003

JAMES E. ROGAN
*Director of the United States Patent and Trademark Office*